United States Patent [19]

Goldfarb et al.

[11] Patent Number: 4,498,886

[45] Date of Patent: Feb. 12, 1985

[54] WHEELED TURBINE-POWERED TOY VEHICLE AND LAUNCHER APPARATUS

[75] Inventors: Adolph E. Goldfarb, 1432 S. East Wind Cir., Westlake Village, Calif. 91361; Delmar K. Everitt, Woodland Hills, Calif.

[73] Assignee: Adolph E. Goldfarb, Westlake Village, Calif.

[21] Appl. No.: 466,081

[22] Filed: Feb. 14, 1983

Related U.S. Application Data

[63] Continuation of Ser. No. 275,982, Jun. 22, 1981, Pat. No. 4,373,290.

[51] Int. Cl.[3] ..... A63H 33/40

[52] U.S. Cl. ..... 446/202; 446/429

[58] Field of Search ..... 46/44, 206, 209, 202

[56] References Cited

U.S. PATENT DOCUMENTS

| | | | |
|---|---|---|---|
| 153,103 | 7/1874 | Minich | 46/206 |
| 2,788,613 | 4/1957 | Gelfand et al. | 46/209 X |
| 3,613,303 | 10/1971 | Allen | 46/206 |
| 3,621,607 | 11/1971 | Morrison et al. | 46/206 |
| 3,696,555 | 10/1972 | Bales et al. | 46/202 |
| 3,789,540 | 2/1974 | Convertine et al. | 46/206 X |
| 3,803,756 | 4/1974 | Strongin | 46/209 X |
| 3,886,682 | 6/1975 | Ieda et al. | 46/209 X |
| 4,324,063 | 4/1982 | Rosenwinkel et al. | 46/209 X |
| 4,363,186 | 12/1982 | Goldfarb et al. | 46/209 |
| 4,373,290 | 2/1983 | Goldfarb et al. | 46/44 |

*Primary Examiner*—Mickey Yu

*Attorney, Agent, or Firm*—Romney Golant Martin & Ashen

[57] ABSTRACT

A wheeled turbine-powered toy vehicle and launcher apparatus. The toy vehicle has at least three spaced-apart ground engaging wheels on which it is supported and a drive mechanism operatively coupled to at least one of the wheels for transmitting rotation to the wheel. The drive mechanism includes a rotatably energy storing flywheel and an air turbine operatively coupled to the flywheel. The apparatus further includes an air delivery tube having a mouthpiece open to the atmosphere for the user to place into his or her mouth and blow air into. The tube has an outlet which is disposed adjacent to the air turbine for directing air against the turbine blades to cause the turbine to rotate. The toy vehicle is designed for use alone or with a launcher. In a preferred form, the launcher supports the toy vehicle above any surface to permit the user to blow into the mouthpiece and impart high speed rotation to the turbine and thus the flywheel, while the ground-engaging drive wheel or wheels of the toy vehicle are free to rotate. For convenience the launcher and toy vehicle mounted on it may be hand-holdable; after the energy has been imparted, the launcher and vehicle may be placed on the ground and the vehicle released and propelled forwardly. In one form the launcher includes a biased propelling member for initially overcoming the vehicle's inertia. In another form the toy vehicle may be manually released from the top of an incline ramp.

9 Claims, 17 Drawing Figures

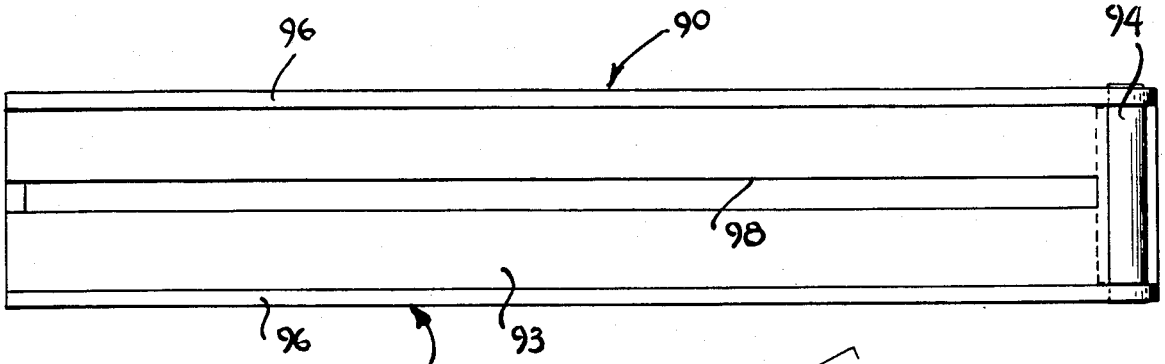
FIG. 15
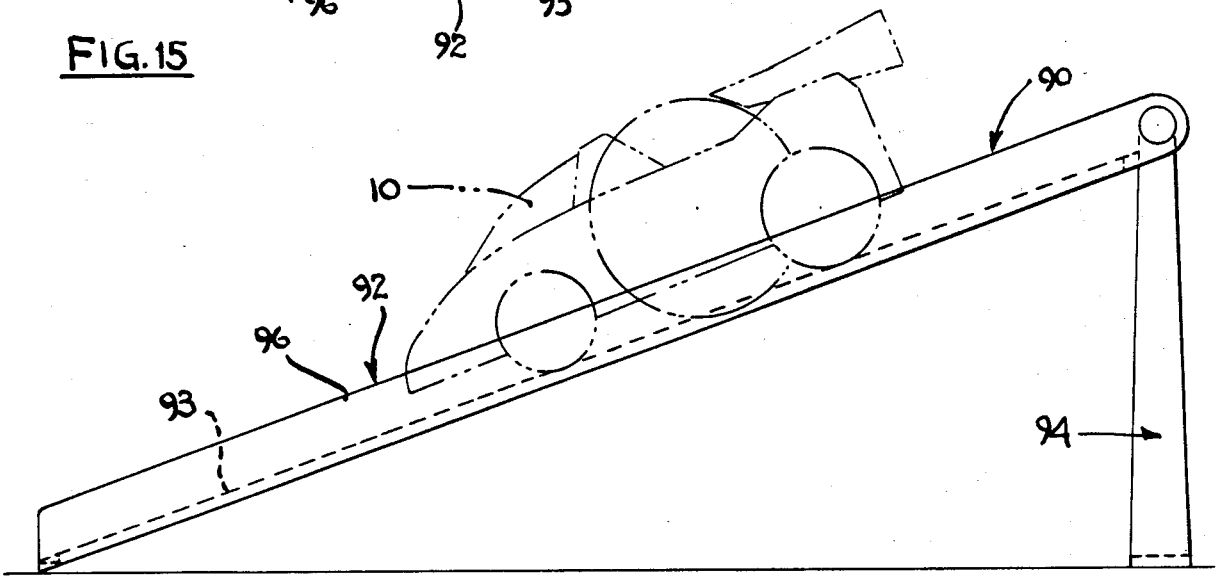
FIG. 16
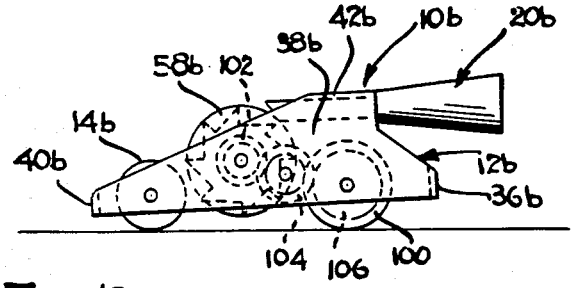
FIG. 12
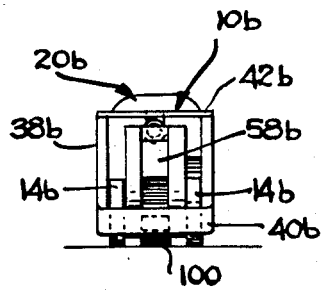
FIG. 14
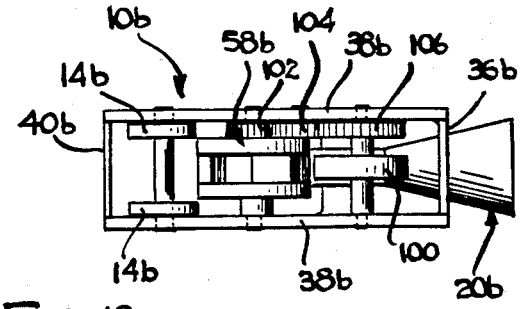
FIG. 13
FIG. 7A
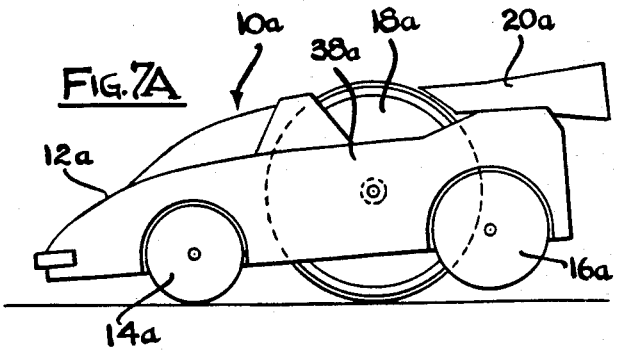

WHEELED TURBINE-POWERED TOY VEHICLE AND LAUNCHER APPARATUS

RELATED APPLICATIONS

This is a continuation of copending application Ser. No. 275,982, filed June 22, 1981, and issued Feb. 15, 1983, as U.S. Pat. No. 4,373,290.

BACKGROUND OF INVENTION

1. Field of Invention

Toy wheeled vehicles, and more particularly such vehicles powered by air turbines and launchers for such vehicles.

2. The Prior Art

There have been various toy vehicles in the prior art which have been powered by air. For example, the Hawk U.S. Pat. No. 819,653 (1909), shows a toy vehicle in which air is pumped into a tank; the air then drives a reciprocating piston which operates through a pulley belt to drive the rear wheels of the toy vehicle. Of more pertinence, some of these prior art devices have utilized air to turn a turbine to power a toy car. In this connection, Allen U.S. Pat. No. 3,613,303 shows the use of an air balloon to provide air to drive a turbine to power a toy car. The turbine drives a gear train which drives the ground engaging drive wheel of the vehicle. The user first blows up the balloon and then places the filled balloon in communication with the conduit leading to the turbine. The force of the air leaving the balloon diminishes quickly as the balloon deflates. Further, the balloon itself would provide considerable drag to the forward movement of the toy vehicle as similar devices are sometimes used for the exact purpose of slowing down a vehicle or aircraft.

The U.S. Pat. No. 3,789,540 to Convertine et al shows a toy car in which a turbine is geared to the drive wheel of the car. The toy vehicle is held on a launcher while air is pumped by means of a hand pump through a conduit against the blades of the turbine. The car is then released by dropping it down on to the incline surface of a launching ramp through operation of a manual lever.

U.S. Pat. No. 3,621,607 to Morrison shows a toy vehicle which is not turbine powered, but which is supported on a launcher while rotational energy is imparted to a single combined flywheel/drive wheel; then the vehicle is propelled forwardly before the drive wheel engages the ground.

SUMMARY OF THE DISCLOSURE

The illustrated and presently preferred forms of the invention provide improved construction wheeled turbine-powered toy vehicles and launching means therefor. The toy vehicle has a frame, at least three spaced-apart ground engaging wheels rotatably mounted on the frame, and drive means on the frame operatively coupled to at least one of the wheels for imparting rotation to the wheel. The drive means includes a rotatable energy storing flywheel to impart rotation to the flywheel. Also mounted on the toy vehicle frame and open to the atmosphere is a mouthpiece for the user to place into his or her mouth and blow air into. The mouthpiece is connected to and in communication with a tube or conduit which has an outlet positioned adjacent to the air turbine for directing air at the air turbine to cause it to rotate rapidly. The vehicle may be used alone or with a launcher. The illustrated forms of launcher include means for releasibly holding the vehicle with its drive wheel disengaged from a supporting surface and free to rotate, and for imparting substantial initial forward motion to the vehicle before allowing the drive wheel to engage the supporting surface. In one form the launcher and vehicle may comprise a hand-holdable unit that can be conveniently held up to the mouth of the user for blowing into the mouthpiece and can then be placed on the ground for launching the vehicle.

A particularly advantageous arrangement for the air turbine and flywheel is to combine them as a single unit wherein the flywheel is positioned in the center and the air turbine is divided into two sections, one section disposed at either side of the flywheel; the air conduit may be bifurcated at its outlet to provide a separate stream of air against each air turbine section. This is a compact yet symmetrical and balanced arrangement for such a device. In a preferred illustrated form, the unitary flywheel/turbine may be movably mounted with regard to a frame having a freely rotatable pair of front wheels and a freely rotatable pair of rear wheels. In one condition, the vehicle may ride on the front and rear wheels and the unitary flywheel/air turbine may simply rest on the ground (by virtue of being supported on the vehicle for vertical movement) and act as the drive wheel for the vehicle. In an alternate condition the flywheel/air turbine may be fixed in a lowered position relative to the frame to elevate one of the pairs of wheels, so that the vehicle is supported by the tri-wheel arrangement of the flywheel/air turbine wheel and the other pair of rotatable wheels. The first condition tends to provide more flexibility of movement in that when the vehicle encounters an obstacle and is diverted from a forward path, it will tend to move forwardly along such altered path. The second condition tends to maintain the vehicle moving more positively along a defined linear path.

One form of illustrated launcher supports the vehicle on a pair of spaced side rails and then pushes the vehicle forwardly along the side rails so that it achieves a substantial forward speed before it leaves the side rails and before the drive wheel is allowed to engage the ground or other supporting surface. Another form of illustrated launcher comprises an inclined ramp having a central groove or recess combined with side positioning walls so that the flywheel/air turbine/drive wheel rotates freely and without interference as the vehicle rolls down the ramp and attains the desired appreciable forward speed before the drive wheel contacts the supporting surface.

IN THE DRAWINGS

FIG. 7A is a side elevational view of another preferred embodiment of wheeled turbine powered toy vehicle in accordance with the invention.

FIG. 12 is a side elevational view of another embodiment of wheeled turbine powered toy vehicle in accordance with the invention.

FIG. 13 is a bottom plan view of the toy vehicle of FIG. 12.

FIG. 14 is a front elevational view of the toy vehicle of FIGS. 12 and 13.

FIG. 15 is a top plan view of a launching ramp for the toy vehicles of FIGS. 1 to 7A.

FIG. 16 is a side elevational view of the ramp of FIG. 15.

DETAILED DESCRIPTION

Figure 6:
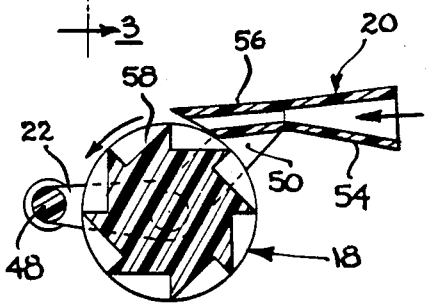
FIG. 6 is a sectional view taken generally along line 6—6 of FIG. 2, illustrating the blow tube and the turbine in section.
Figure 4:
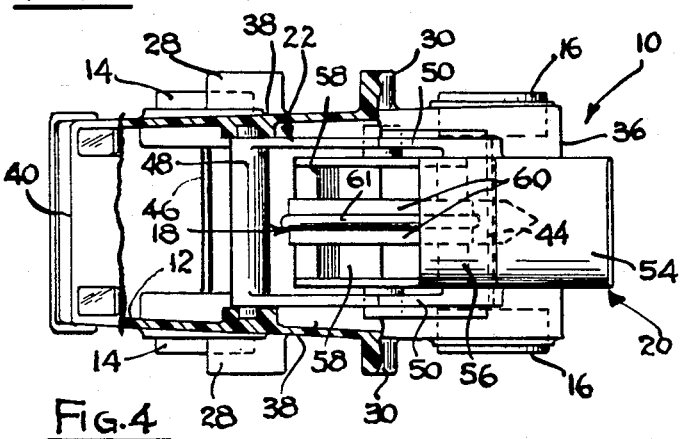
FIG. 4 is a top plan view, partially in section, taken generally along line 4—4 of FIG. 3.
Figure 5:
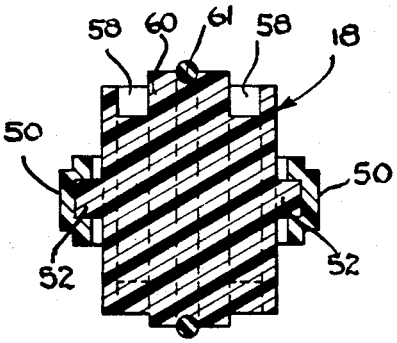
FIG. 5 is an enlarged transverse section taken generally along line 5—5 of FIG. 3, illustrating the composite flywheel/turbine/drive wheel.
Figure 7:
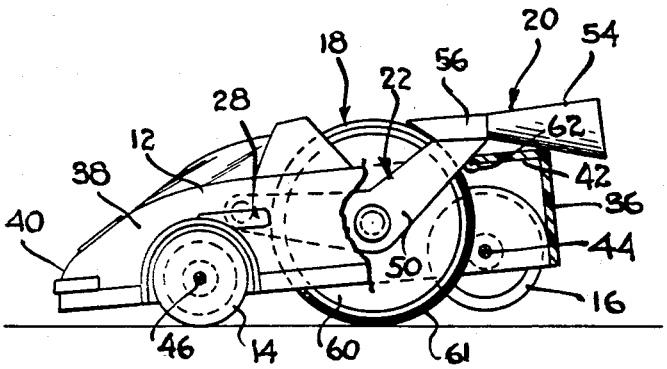
FIG. 7 is a side elevational view, partially broken away, showing the toy vehicle of FIG. 1 in an alternate condition.
Figure 8:
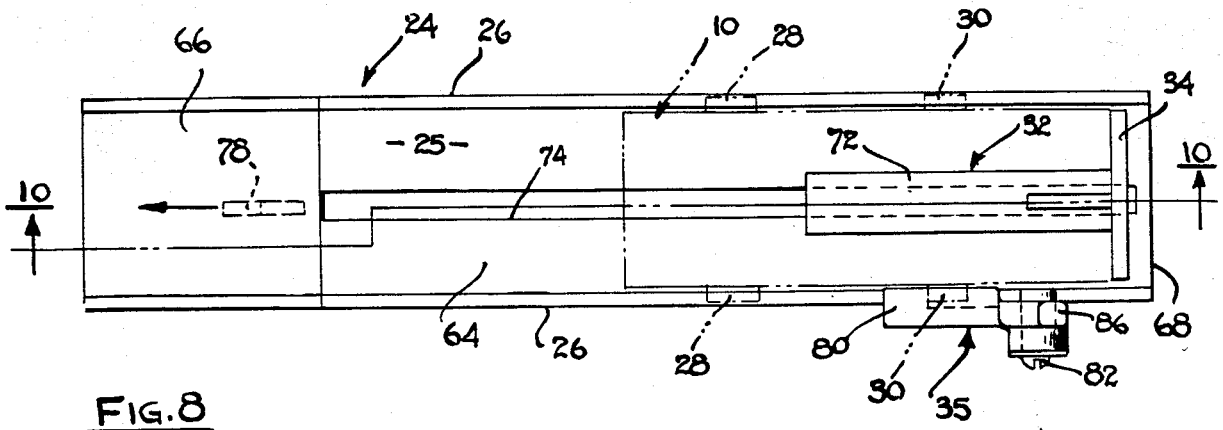
FIG. 8 is a top plan view of a propelling launcher for use with the toy vehicles of FIG. 1 through 7A, with the outline of a vehicle shown in broken line.
Figure 9:
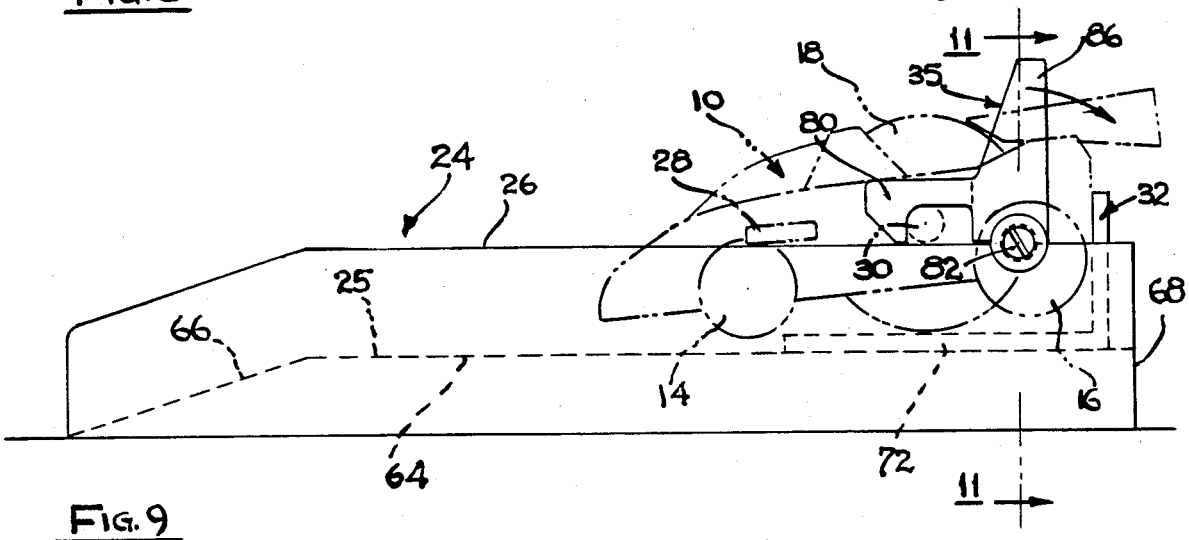
FIG. 9 is a side elevational view of the launcher of FIG. 8 showing the toy vehicle in broken line.
Figure 10:
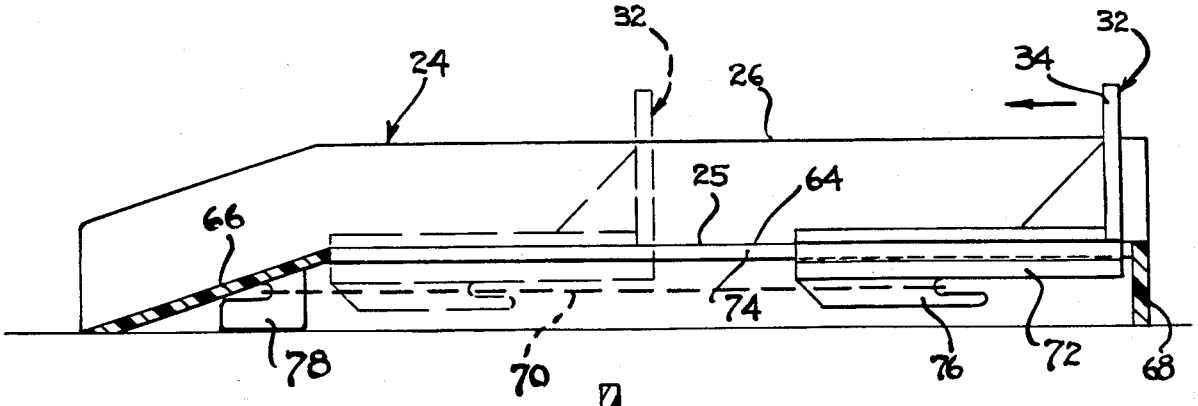
FIG. 10 is a side sectional view taken generally along line 10—10 of FIG. 8.

Now considering the illustrated apparatus in further detail, FIGS. 1 through 7 illustrate a presently preferred embodiment of a wheel turbine powered toy vehicle 10 in accordance with the present invention. In general, the illustrated toy vehicle 10 comprises a generally box-like body or frame 12, a pair of rotatable front wheels 14, a pair of rotatable rear wheels 16, and a large rotatable combination drive wheel/turbine/flywheel unit 18 supported generally centrally of the frame. A blow tube 20 is mounted on the vehicle by which the user can direct a flow of air against the blades of the turbine to impart rotation to the unit 18. The unit 18 may be rotatably mounted on a carrier or yoke 22 pivotally mounted on the frame to permit the unit 18 to move generally vertically. The yoke 22 has a locked or fixed position, and a free or floating position. With the yoke 22 in a fixed or locked position, as shown in FIG. 7, the rotatable unit 18 is located relative to the frame so as to elevate the rear wheels 16 off the supporting surface. In the other position best illustrated in FIGS. 1, 2 and 3, the vehicle rests upon both the front and rear wheel 14, 16 and the yoke 22 is free to pivot about its axis. This permits the rotatable unit 18 to rest upon the supporting surface by virtue of its own weight, and by virtue of its rotational stored energy to impart forward driving force to the toy vehicle. In one mode of operation, the user may grasp the toy vehicle in his or her hand, may blow into the blow tube 20 to impart rapid rotation to the drivewheel unit 18, and may then place the vehicle on a supporting surface either directly downward or with some forward impetus, and the drive wheel unit will tend to drive the toy vehicle forward along the surface. The illustrated toy vehicle 10 may also be used advantageously in conjunction with a launcher 24 as illustrated in FIG. 8–11. In general, the illustrated launcher 24 comprises a horizontal platform wall 25 and a pair of spaced side rails 26 which support side projections 28, 30 on the vehicle to maintain the vehicle in an elevated position on the launcher The launcher 24 includes propelling means in the front of a forwardly biased starter or pusher 32 which is mounted on the launcher for longitudinal movement and includes an upright rear wall 34. With the toy vehicle mounted on the launcher in ready position as illustrated in FIGS. 8 and 9, the upright wall 34 of the pusher bears against the rear of the vehicle, while a manually operable latch 35 pivotally mounted on one side of the launcher engages one of the side projections 30 on the vehicle to restrain the vehicle and pusher from forward movement When the latch 35 is released, the pusher 32 is biased forwardly toward the position shown in broken line in FIG. 10 to propel the vehicle forwardly. It will be noted from FIG. 9 that the launcher and the vehicle are configured so that the wheels 14, 16, 18 of the vehicle are elevated above the horizontal platform wall 25 of the launcher; in particular, the drivewheel unit 18 is free to rotate. Only after the vehicle has been propelled forwardly of the launcher onto a supporting surface on which the launcher is disposed will the wheels of the vehicle engage the supporting surface. This permits the stored energy in the rotating drive wheel unit to be used for maintaining forward movement of the vehicle, without having to overcome inertia to initiate such forward movement.

Now to consider the illustrated structures in further detail, the illustrated toy vehicle frame or body 12 has a generally upright rear wall 36, a pair of upright side walls 38, a short upright front wall 40, and transversely extending top wall portions 42. The body 12 may be representative of real or fictitious vehicles and is illustrated as having a generally pointed or needle-nose configuration. The pair of rear wheels 16 are fixed on a transverse rear axle 44 that is rotatably mounted adjacent the rear of the body. The pair of front wheels 14 are fixed on a transverse front axle 46 rotatably mounted adjacent the forward end of the body. As shown best in FIGS. 4 and 9, there are the outwardly extending projections 28, 30 on each side of the body 12. The projections 28, 30 are generally intermediate the height of the toy vehicle. On each side there is a generally horizontal tab 28 located just to the rearward of the front wheel, and there is a cylindrical hub 30 located somewhat to the rear of the mid-point between the front and rear axles. As noted above, the projections 28, 30 are adapted to ride on the sidewalls or rails 26 of the launcher 24 and to thereby elevate the wheels 14, 16, 18 of the vehicle above the platform wall 25 of the launcher as shown best in FIG. 9.

Figure 2:
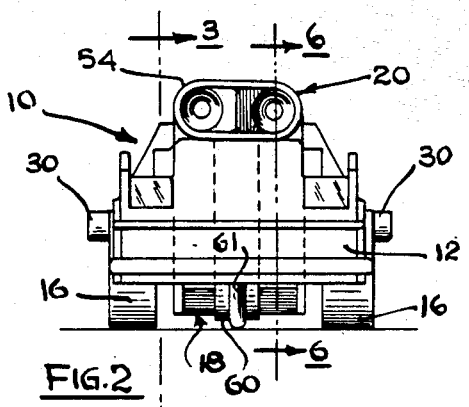
FIG. 2 is a rear elevational view of the toy vehicle of FIG. 1.

The yoke or carrier 22 has a transverse rod portion 48 which is pivotally mounted between the side walls 38 of the vehicle body at approximately the front tabs 28. The carrier 22 further includes a pair of rearwardly extending arms 50 each having a first section which extends generally horizontally rearwardly and a second section which then extends upwardly at about a 45 degree angle. The illustrated drivewheel unit 18 is mounted between the arms 50. As shown best in FIG. 5, the drivewheel unit 18 has a pair of opposed outwardly extending hubs 52 which are received in mating cylindrical receptacles in the respective arms 50. The outer rearward ends of the arms 50 are integrally formed with the blow tube 20. The illustrated blow tube 20 includes a rearward mouthpiece section 54 which is flattened and elongated side-to-side as shown in FIG. 2 and may be grasped in the mouth of the user and blown into. This mouthpiece section 54 converges inwardly in the forward direction and communicates with a forward conduit and outlet section 56 designed to direct the flow of blown air against air turbine sections 58 of the drivewheel unit 18. The mouthpiece section 54 narrows to provide a nozzle that increases the velocity of the air flow. In the illustrated device as shown best in FIG. 4, a flywheel/drivewheel section 60 of the unit 18 is disposed generally centrally side-to-side of the toy vehicle while there is an air turbine section 58 at either side. The outlet section 56 of the blow tube 20 is bifurcated to channel and focus an airflow against each of the side turbine sections 58. This arrangement provides balance and symmetry in a very compact arrangement. As best illustrated in FIG. 6, the outlet section 56 is cut off at an angle at its forward end to approximate the mating contour of the adjacent turbine section 58. The central drivewheel/flywheel section 60 of the rotatable unit 18 is shown with an annular groove which receives an "O" ring 61 of rubber or the like to provide a narrow contact surface that will permit limited slippage during acceleration.

As noted above, the carrier 22 may be in either of two operating positions: a free floating position or a locked position. When in the locked position as shown in FIG. 7, the drivewheel unit 18 is secured in a fixed position relative to the body 12 so as to extend a greater distance below the body then either the front or rear wheels of the vehicle. Since the drivewheel unit 18 is located toward the rear of the vehicle, the greater part of the weight of the vehicle is forwardly of the drivewheel unit and therefore the front wheels 14 engage the supporting surface as shown in FIG. 7. The carrier may be releasibly latched in this position as by means of a tab 62 which is resiliently forced past a mating lip of a rear section of the frame upper wall 42 as illustrated in FIG. 7. When in this condition, the vehicle is essentially supported on three wheels, and exhibits a strong tendency to maintain stable straight forward travel.

Figure 1:
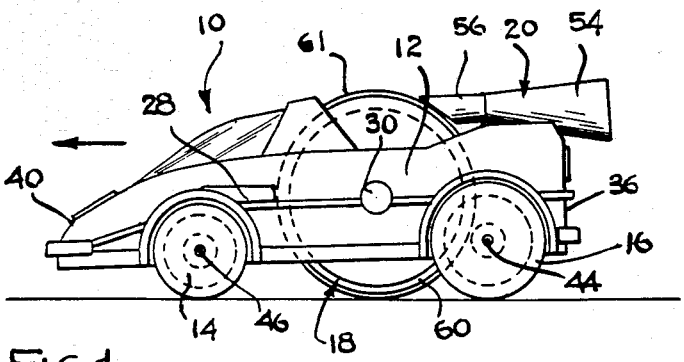
FIG. 1 is a side elevational view of a presently preferred embodiment of a wheeled turbine powered toy vehicle.
Figure 3:
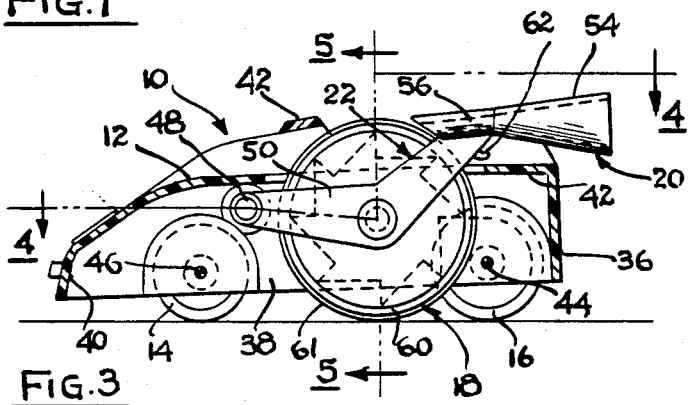
FIG. 3 is a longitudinal sectional view taken generally along line 3—3 of FIG. 2.

When the carrier 22 is unlatched from the body 12 so that it is free to rotate about its transverse axis, the vehicle will tend to rest on both the front and rear wheels 14, 16 with the drivewheel unit 18 simply resting on the supporting surface by virtue of its own weight as shown in FIGS. 1–3. In other words, the carrier 22 pivots around its transverse axis to permit the drivewheel unit to rest upon the supporting surface. Pivoting of the carrier 22 may be limited by engagement of portions of the carrier or the blow tube with the vehicle body. In this condition, the drivewheel unit will still drive the vehicle forwardly and there will be generally five wheel support for the vehicle. In this condition, the toy vehicle exhibits a greater ability to accommodate to interference with its travel (as when it runs into a barrier or wall) and it will simply tend to continue on in the new orientation.

FIG. 7A shows another preferred form of wheeled turbine powered toy vehicle **10*a* which is very similar to vehicle 10. The basic difference between vehicles 10 and 10*a* is that the drivewheel unit 18*a* in vehicle 10*a* is fixed in one location comparable to the locked position of unit 18 in vehicle 10 as shown in FIG. 7. The yoke or carrier 22 is omitted, and unit 18*a* is supported for rotation between the side walls 38*a* of body 12*a* of vehicle 10*a* by conventional means. Further, in vehicle 10*a*, there are a pair of front wheels 14*a* and a pair of rear wheels 16*a*. The blow tube 22*a* is mounted directly on the body 12*a*, rather than on a carrier as in vehicle 10. Vehicle 10*a* will function exactly like vehicle 10 when the latter is in its locked position of FIG. 7. The rear wheels 16*a* facilitate use on launcher of FIGS. 15 and 16**.

The user may grasp the vehicle 10 or **10*a*, blow into the mouthpiece to impart rapid rotation to the turbine/flywheel/drivewheel, and place the vehicle onto the ground; the drivewheel will propell the vehicle rapidly forward. Of course vehicles 10 and 10*a*** are self-standing and thus also capable of play as ordinary wheeled toy cars.

Figure 11:
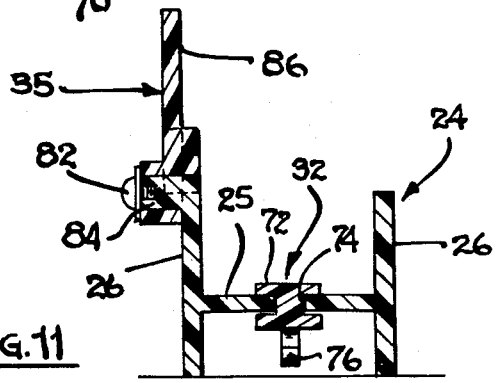
FIG. 11 is a transverse sectional view taken generally along line 11—11 of FIG. 9.

As noted above, FIGS. 8–11 illustrate a preferred embodiment of launcher may be used with the toy vehicles of FIGS. 1–7 and FIG. 7A. As noted above, the illustrated launcher 24 is an elongated structure having the pair of upright sidewalls 26 which are parallel and spaced apart, and connected together by the transversely extending platform or bottom wall 25. The platform wall 25 includes an elongated generally horizontal rear section 64 which extends the major length of the launcher, and a forward section 66 which connects to the forward edge of section 64 and slopes downwardly to the surface on which the launcher is supported to provide a discharge or transition ramp. At its rearward end, the section 64 may be connected to the upper edge of a launcher rear wall 68. The launcher may be constructed of suitable material such as molded plastic, wood, metal, etc. As shown best in FIG. 8, the launcher 24 is proportioned to receive the vehicle between the side walls 26, with the vehicle supported spaced above the platform wall 25 as illustrated in FIG. 9. As described above, the vehicle is supported by the side projections 28, 30 which rest on the upper edge of the side walls 26. These upper edges are generally horizontal for the extent of the horizontal rearward section 64 of the launcher platform wall, and then the edges incline downwardly so as to continue to extend generally parallel to the downwardly inclined section 66 of the platform wall. The illustrated launcher 24 includes the means for propelling the vehicle forwardly and latch means for holding the vehicle in the position illustrated in FIGS. 8 and 9 against the force of the propelling means. More particularly, the propelling means comprises the starter or pusher 32 movably mounted on the platform wall 25 for longitudinal movement therealong under the force of biasing means 70 such as a spring or a rubber band. The illustrated starter 32 comprises the upright transversely extending rear wall 34 that extends upwardly from the rear end of a horizontally and longitudinally extending base or main section 72. The base section 72 is generally "I" shaped in cross section as illustrated in FIG. 11. The intermediate or mid-portion of the base section 72 is received within a longitudinally extending slot 74 that extends substantially the full length of the horizontal platform wall 25 down its center. The top and bottom portions of the "I" shaped base section 72 overlie and underlie respectively the portions of the platform wall 25 to either side of the slot 74. In this way, the base section 72 is maintained within the slot 74 for sliding movement longitudinally of the slot. Means forming a hook 76 may be provided at the underside of the starter 32 and other means forming a hook 78 may be provided at the underside of the platform wall 25 toward its front end. Biasing means such as a rubber band 70 (illustrated by a broken line in FIG. 10) may be disposed between the hooks 76,78 to bias the starter 32 from the position shown in solid line at the rear of the launcher in FIG. 10 toward the forward position shown in broken line at the forward end of the horizontal wall section 64. The toy vehicle may be placed on the launcher and pushed rearwardly to thereby move the starter 32 to the the rearward position against the force of the biasing means. The latch 35 is pivotally mounted on one of the launcher side walls 26 in position so that a finger 80 of the latch can engage one of the rearward side projections 30 on the vehicle and thereby restrain the vehicle and the starter from forward movement. This latched position is illustrated in FIG. 9. As shown in FIGS. 9 and 11, the latch 35 may be mounted as by means of a small screw 82 and an outwardly extending stud 84 on the side wall 26. The latch 35 also includes a release lever portion 86 which may be moved rearwardly in the direction of the arrow in FIG. 9 by the user, to disengage the latch finger 80 from the projection 30 and thereby release the toy vehicle.

When the latch 35 is released, the rubber band 70 is free to bias the starter 32 rapidly forwardly, which in turn propells the toy vehicle forwardly under the influence of the rear upright pusher wall 34 of the starter. The toy vehicle rides along the upper edges of the side walls 26 without any of the wheels 14, 16, 18 of the vehicle engaging the platform wall 25 of the launcher. At the forward end of the launcher the vehicle moves down the short discharge incline, however the wheels of the vehicle still do not engage the platform wall because the downward incline of the side walls matches that of the platform wall. As the toy vehicle continues to move forwardly it disengages from the launcher and its wheels engage the ground or other supporting surface. All the while the drive wheel unit 18 has been rapidly rotating; when it engages the supporting surface the vehicle is moving forwardly at a substantial speed so that the drive wheel need not overcome inertia of a standing start but rather its energy may be utilized to maintain the rapid forward travel of the toy vehicle.

FIGS. 15 and 16 illustrate a modified preferred embodiment of launcher 90 having an elongated straight ramp or platform section 92 which is pivotally connected at its rearward end to an elongated support section 94. With the support section 94 disposed generally upright and its lower end on a supporting surface, the ramp section 92 then inclines downwardly from an elevated point to the supporting surface. The ramp section 92 includes a platform wall 93 having an upright side wall or side rail 96 disposed along either side. Extending longitudinally and centrally of the ramp wall 93 is an elongated slot 98 adapted to provide clearance for the central drive wheel unit 18 as the vehicle moves down the ramp section. Thus, the toy vehicle 10 or **10*a* may be placed at the top of the ramp section 92 with the drive wheel unit rotating rapidly, and the vehicle may be released. It will roll down the inclined ramp wall 93 on wheels 14 and 16 to pick up appreciable speed and the side rails 96 will maintain it along its desired linear path, with the drive wheel unit being free to rotate without engagement by virtue of the central slot 98. By the time the toy vehicle reaches the supporting surface, it will be moving forwardly at a rapid rate, at which time the drive wheel unit 18 will engage the supporting surface to maintain that forward motion of the toy vehicle. When the launcher 90 is not being utilized, the support section 94 may be rotated to a position generally parallel to the ramp section 92** for compact and convenient storage.

FIGS. 12 through 14 illustrate another perferred embodiment of a toy vehicle **10*b* of the present invention. This vehicle comprises a somewhat box-like open frame or body 12*b* having a pair of side walls 38*b*, a rear wall 36*b*, a front wall 40*b*, and top wall portions 42*b*. A pair of front wheels 14*b* are fixed on a transverse front axle which is rotatably mounted between the side walls 38*b* adjacent the front of the vehicle. A single rear drive wheel 100 is fixed on a transverse rear axle which is rotatably mounted between the side walls 38*b* adjacent the rear of the toy vehicle. The frame 12*b* also carries a rotatable air turbine 58*b* which is connected through a gear train to the rear drive wheel 100. More particularly, the air turbine 58*b* is mounted on a transverse shaft which is rotatably supported between the side walls 38*b* of the frame intermediate the front and rear wheels. A drive gear 102 is fixed on the air turbine shaft and meshes with an intermediate gear 104 mounted on a shaft rotatably supported in one of the side walls 38*b*. The intermediate gear 104 in turn meshes with a drive gear 106 co-axially fixed on the shaft of the rear drive wheel 100. The speed of rotation of the air turbine 58*b* is substantially geared down by the gear train so that the more rapid rotation of the turbine is translated into a slower and more powerful rotation at the rear drive wheel 100 of the vehicle. A blow tube 20*b* having a flared mouth piece 54*b* is mounted on the frame 12*b*, with an outlet end 56*b* positioned adjacent to the air turbine 58*b* so that the flow from the outlet will bear upon the turbine blades and impart rotation to the turbine. The blow tube extends rearwardly from the frame to position the mouth piece 54*b* where it can be conveniently held in the mouth of the user to blow air aqainst the turbine blades. It will be noted that a single tube is utilized for the blow tube 20*b* as distinguished from the bifurcated form of tube 20 utilized in the vehicle 10 of FIGS. 1 through 7. The vehicle 10*b* may be used alone or in conjunction with a launcher. For example, the vehicle 10*b* could be provided with side tabs such as shown as 28, 30 on vehicle 10 so that vehicle 10*b* could be used with the launcher of FIGS. 8–10**.

Various modifications and changes may be made in the illustrated structures without departing from the spirit and scope of the present invention. For example, as noted above, the particular appearance or configuration of the toy vehicle may be changed as desired. As another example, the particular means for mounting the drive wheel unit might take an alternate form such as the unit having outwardly extending projections or hubs that are received in generally vertical slots in the sides of the vehicle frame to provide the capacity for vertical movement. Further, the blow tube might be mounted on the launcher rather than on the vehicle with the blow tube outlet being positioned so that it is in the proper location relative to the turbine when the toy vehicle is mounted on the launcher. Various alternate means for propelling the vehicle forwardly may be utilized as for example a spring loaded plunger. Thus, the present invention is not limited to the illustrated structures, but is as set forth in the following claims.

What is claimed is:

1. In combination, a turbine-powered wheeled toy vehicle for energization by a child user's breath and for operation on a play surface, and a launcher for such vehicle; said combination being adapted to permit such child user to hold the vehicle and launcher in his hand, in an energization position, and to use his breath to bring the vehicle turbine up to speed when the vehicle and launcher are held in such an energization position, and to place the vehicle and launcher in a proper release position upon such play surface after the turbine is up to speed. and to then release the vehicle onto such play surface in an operating position, with the turbine still up to speed and with the vehicle in a suitable orientation relative to such play surface; said combination comprising:

(a) a toy vehicle that is small enough to be readily hand-held by such child user and that has:
a flywheel that is rotatably mounted to the vehicle, and that is positioned and adapted to engage such surface and thereby to propel the vehicle relative to such surface,
an air turbine integral with the flywheel, and
an air conduit mounted to the vehicle, and having an inlet adapted to receive such a user's breath, and having an outlet disposed adjacent the turbine to effectively convey such breath to the turbine to energize the turbine;

(b) a small launcher that is small enough and otherwise adapted to be hand-held by such child user and that is adapted to be placed stablely upon such surface, and that comprises:
gripping means for releasably gripping the vehicle, while the launcher is hand-held by such child user, in condition for receipt of such user's breath by the conduit inlet,
supporting means for supporting the vehicle, with the flywheel disengaged from the launcher, and with the flywheel disengaged from such surface even if the launcher is placed upon such surface, for free-wheeling rotation by the flywheel when the vehicle is gripped by the gripping means and when such user's breath is received by the conduit inlet,
releasing means, actuable by such user, for releasing the vehicle from the gripping means, and
impelling means for impelling the vehicle, when it is released by the gripping means, from the launcher to such surface so that the flywheel can engage such surface to propel the vehicle;

whereby said combination assists such child user to use his breath to bring the vehicle turbine up to speed when the vehicle and launcher are held in the child user's hand in such an energization position, and to place the vehicle and launcher in a proper release position upon such play surface after the turbine is up to speed, and to then release the vehicle onto such play surface in an operating position, with the turbine still up to speed and with the vehicle in a suitable orientation relative to such play surface; and a blow tube that is:
secured to the launcher;
adapted to be placed in such user's mouth, while the launcher is hand-held by such user, to receive such user's breath; and
positioned, aligned, and adapted to convey such breath to the inlet of the air conduit of the vehicle, when the vehicle is gripped by the gripping means.

2. In combination, a wheeled toy vehicle that is self-powered by an air turbine, and a launcher for said vehicle; the said combination comprising:

(a) a toy vehicle having a frame, rotatable ground engaging wheel means on the frame proportioned and arranged to maintain the vehicle upright and including at least one drive wheel, and drive means on the frame and operatively coupled to said drive wheel for imparting rotation to said drive wheel, said drive means including a rotatable energy storing fly wheel member and an air turbine operatively coupled to said fly wheel member to impart rotation to the fly wheel member;

(b) a launcher which includes means for supporting said toy vehicle in a predetermined position on the launcher, said lancher being positionable on a supporting surface for launching of the toy vehicle; and (c) user blow means, at least in part mounted on the launcher, for directing a flow of user-blown air against said air turbine so as to cause it to rotate, said blow means comprising:
a mouthpiece mounted on the launcher, open to the atmosphere and positioned for the user to place into his or her mouth and blow air into, and
conduit means with an outlet, said conduit means being connected to and in communication with the mouthpiece for directing air blown into the mouthpiece out of said outlet, said outlet being positioned, when said vehicle is in said predetermined position on the launcher, so that said outlet is adjacent to said air turbine so as to direct air at said air turbine so as to cause it to rotate;

said launcher further including a movable starter element mounted on said launcher for longitudinal movement in a rear to front direction, said element being positioned to engage the toy vehicle when the latter is mounted on the launcher and to propel the vehicle forwardly along the launcher to overcome the vehicle's inertia in a standing start;

whereby substantially all the energy stored in the flywheel may be utilized to maintain rapid forward travel of the vehicle after such start.

3. The combination of claim 2 wherein:

said starter element includes means which engage the vehicle, and said launcher further includes:
means for biasing said starter element in the forward direction, and
latch means for restraining forward movement of said starter element and said vehicle in response to said biasing means until said latch means are released by the user.

4. The combination of claim 3 wherein said launcher comprises a pair of spaced apart parallel side rails and said toy vehicle includes outwardly extending projections at either side thereof for resting upon said side rails, said vehicle being supported by said projection means and side rails so that said drive wheel is out of engagement with other surfaces and free to rotate.

5. The combination of claim 1 wherein said flywheel member and said turbine are coaxial and interconnected for common rotation.

6. The combination of claim 5 wherein said drive wheel is also coaxial and interconnected with said flywheel member and said turbine for common rotation.

7. The combination of claim 5 wherein there is a gear train on said frame between said flywheel member and said drive wheel.

8. The combination of claim 7 wherein said gear train substantially reduces the speed of rotation from said flywheel member to said drive wheel.

9. The combination of claim 7 wherein said drive wheel is located generally centrally side-to-side and said wheel means also includes a pair of rotatable support wheels.

* * * * *